US005842104A

United States Patent [19]

Hazama et al.

[11] Patent Number: 5,842,104

[45] Date of Patent: Nov. 24, 1998

[54] IMAGE-FORMING DEVICE AND A PROCESS UNIT THEREFOR HAVING A GUIDE PLATE WITH MULTIPLE OPENINGS

[75] Inventors: Hiroyuki Hazama; Nariaki Tanaka; Takashi Terada, all of Osaka, Japan

[73] Assignee: Mita Industrial Co., Ltd., Osaka, Japan

[21] Appl. No.: 911,729

[22] Filed: Aug. 15, 1997

[30] Foreign Application Priority Data

Aug. 23, 1996 [JP] Japan ..... 8-222048
Jun. 27, 1997 [JP] Japan ..... 9-172363

[51] Int. Cl.[6] ..... G03G 21/18

[52] U.S. Cl. ..... 399/400; 399/397

[58] Field of Search ..... 399/400, 121, 399/397

[56] References Cited

U.S. PATENT DOCUMENTS 5,016,060 5/1991 Arai ..... 399/400
5,166,737 11/1992 Tomita ..... 399/400

FOREIGN PATENT DOCUMENTS 63-127274 5/1988 Japan .
6-186873 7/1994 Japan .
8-95325 4/1996 Japan .

*Primary Examiner*—Arthur L. Grimley
*Assistant Examiner*—Quana Grainger
*Attorney, Agent, or Firm*—Beveridge, DeGrandi, Weilacher & Young, LLP

[57] ABSTRACT

An image-forming machine includes a photosensitive drum rotatably disposed; a charger for electrically charging the peripheral surface of the photosensitive drum to a predetermined polarity; a developer for developing an electrostatic latent image formed on the peripheral surface of the photosensitive drum into a toner image; a transfer device for transferring the toner image formed on the peripheral surface of the photosensitive drum onto a transfer paper; a fixing roller for heat-fixing the toner image transferred onto the transfer paper by the transfer device; and a cooling fan for blowing cooling air to the surrounding area of the fixing roller. A guide plate having a plurality of openings formed along its length, guides the transfer paper onto which the toner image has been transferred by the transfer device, to the fixing roller.

6 Claims, 5 Drawing Sheets

IMAGE-FORMING DEVICE AND A PROCESS UNIT THEREFOR HAVING A GUIDE PLATE WITH MULTIPLE OPENINGS

FIELD OF THE INVENTION

The present invention relates to an image-forming machine such as an electrostatic copier or a laser printer, which develops a toner image from an electrostatic latent image formed on a photosensitive layer of a photosensitive drum, and transfers the toner image onto a transfer paper; and to a process unit adapted to the image-forming machine.

DESCRIPTION OF THE PRIOR ART

An image-forming machine of this type comprises a photosensitive drum which is rotatably disposed and passes successively through a charging zone, an electrostatic latent image-forming zone, a developing zone and a transfer zone; a charger disposed in the charging zone and for charging the peripheral surface of the photosensitive drum to a predetermined polarity; a developer disposed in the developing zone for developing a toner image from an electrostatic latent image formed on the peripheral surface of the photosensitive drum in the electrostatic latent image-forming zone; and a transfer means disposed in the transfer zone and for transferring the toner image formed on the peripheral surface of the photosensitive drum onto a transfer paper. Further, a fixing means is disposed on the downstream side of the transfer means in the direction of conveying the transfer paper in order to heat-fix the toner image transferred onto the transfer paper by the transfer means. In order to prevent the surrounding area from being heated by the fixing means, cooling air blown by a cooling fan is permitted to flow around the fixing means.

Between the transfer means and the fixing means is disposed a guide plate for guiding the transfer paper, onto which the toner image is transferred by the transfer means, to the fixing means. Here, however, heat radiated from the fixing means builds up under the guide plate, which causes overheating.

SUMMARY OF THE INVENTION

The object of the present invention is to provide an image-forming machine capable of efficiently cooling the lower side of the guide plate after the transfer operation, so that heat radiated from the fixing means will not build up under the guide plate, and a process unit for the image-forming machine.

In order to accomplish the above-mentioned object according to the present invention, there is provided an image-forming machine comprising:

a photosensitive drum rotatably disposed;

a charger for electrically charging the peripheral surface of said photosensitive drum to a predetermined polarity;

a developer for developing an electrostatic latent image formed on the peripheral surface of said photosensitive drum into a toner image;

a transfer means for transferring the toner image formed on the peripheral surface of said photosensitive drum onto a transfer paper;

a fixing means for heat-fixing the toner image transferred onto the transfer paper by said transfer means; and a cooling fan for blowing cooling air to the surrounding of said fixing means; wherein provision is made of a guide plate having a plurality of openings formed in the lengthwise direction and for guiding the transfer paper, onto which the toner image is transferred by said transfer means, to said fixing means.

According to the present invention, furthermore, there is provided an image-forming machine comprising:

a photosensitive drum rotatably disposed;

a charger for electrically charging the peripheral surface of said photosensitive drum to a predetermined polarity;

a developer for developing an electrostatic latent image formed on the peripheral surface of said photosensitive drum into a toner image;

a transfer means for transferring the toner image formed on the peripheral surface of said photosensitive drum onto a transfer paper;

a fixing means having a heating roller for heat-fixing the toner image transferred onto the transfer paper by said transfer means and a pressing roller disposed on the upper side of said heating roller in contact therewith; and a cooling fan for blowing cooling air to the surrounding of said fixing means; wherein said pressing roller constituting said transfer means is disposed in contact with said heating roller on the downstream side of a vertical line passing through an axis of said heating roller in the direction of conveying the transfer paper;

between said transfer means and said fixing means is disposed a guide plate for guiding the transfer paper, onto which the toner image is transferred by said transfer means, to said fixing means, said guide plate extending up to the upper side of said heating roller; and said guide plate is provided with a plurality of openings in the lengthwise direction.

According to the present invention, furthermore, there is provided a process unit for an image-forming machine, which can be detachably attached to a machine housing having a fixing means and a cooling fan for blowing cooling air to the surrounding of said fixing means, said process unit for an image-forming machine comprising, fabricated as a unitary structure:

a photosensitive drum rotatably disposed to successively pass through a charging zone, an electrostatic latent image-forming zone, a developing zone and a transfer zone;

a charger disposed in said charging zone for electrically charging the peripheral surface of said photosensitive drum to a predetermined polarity; and a developer disposed in said developing zone for developing into a toner image the electrostatic latent image formed on the peripheral surface of said photosensitive drum in the electrostatic latent image-forming zone; wherein provision is made of a guide plate having a plurality of openings formed in the lengthwise direction and for guiding the transfer paper, onto which the toner image is transferred by said transfer means, to said fixing means.

DETAILED DESCRIPTION OF THE PREFERRED EMBODIMENTS

Described below in detail with reference to the accompanying drawings is an image-forming machine constituted according to an embodiment of the present invention. Here, the illustrated embodiment will be described using for an example a printer as the image-forming machine constituted according to the present invention.

Figure 1:
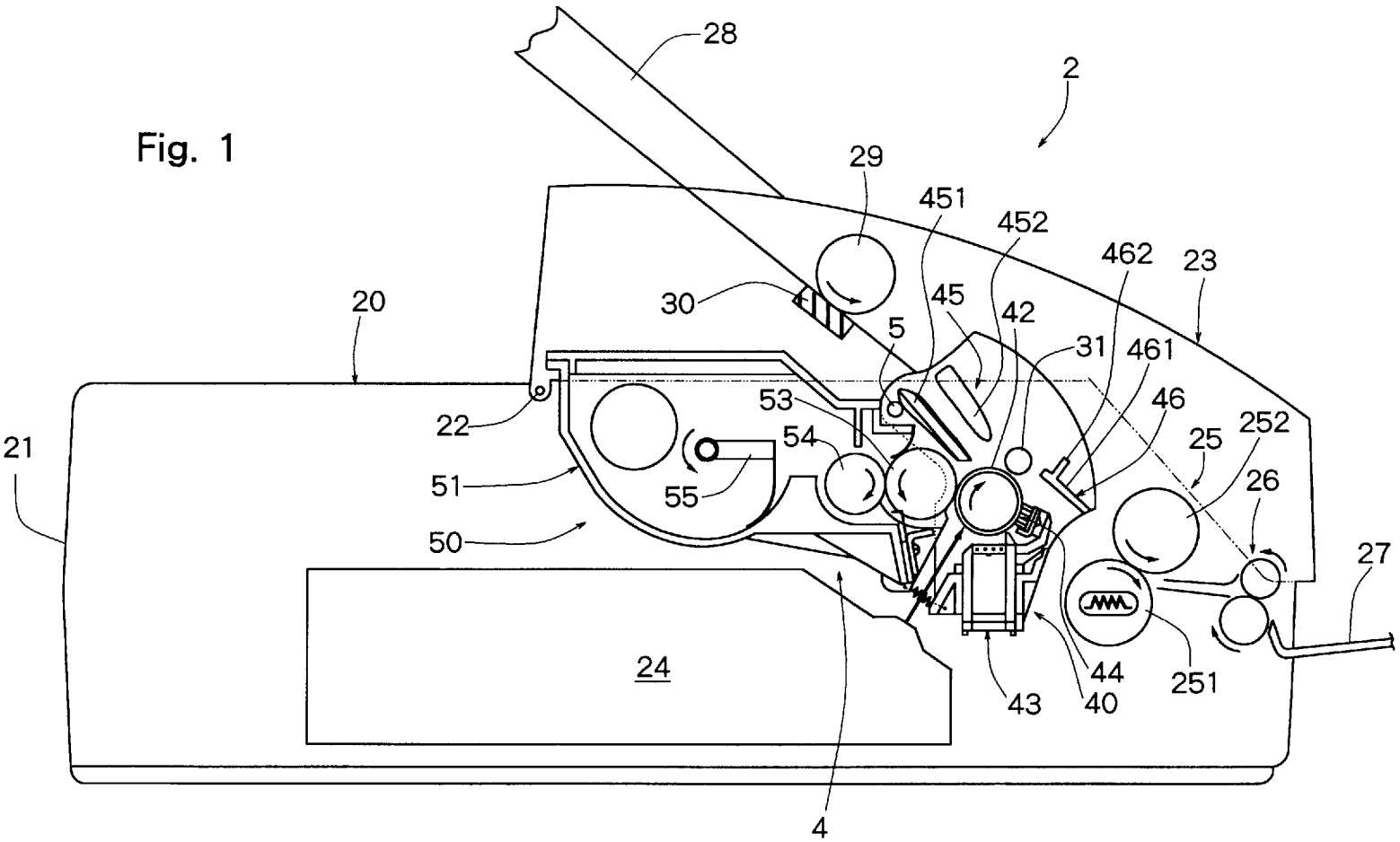
FIG. 1 is a front view schematically illustrating an image-forming machine constituted according to an embodiment of the present invention.

FIG. 1 schematically illustrates a printer constituted according to an embodiment of the present invention. In this embodiment, the printer 2 is a compact, low-speed laser printer used for a word processor and the like, and has a machine housing 20 formed by molding a plastic material. The machine housing 20 includes an upwardly open box-shaped housing body 21, and a cover 23 mounted to turn on a shaft 22 disposed at the upper part of the housing body 21. A process unit 4 is detachably mounted in the central portion in the machine housing 20 constituted as described above.

Figure 2:
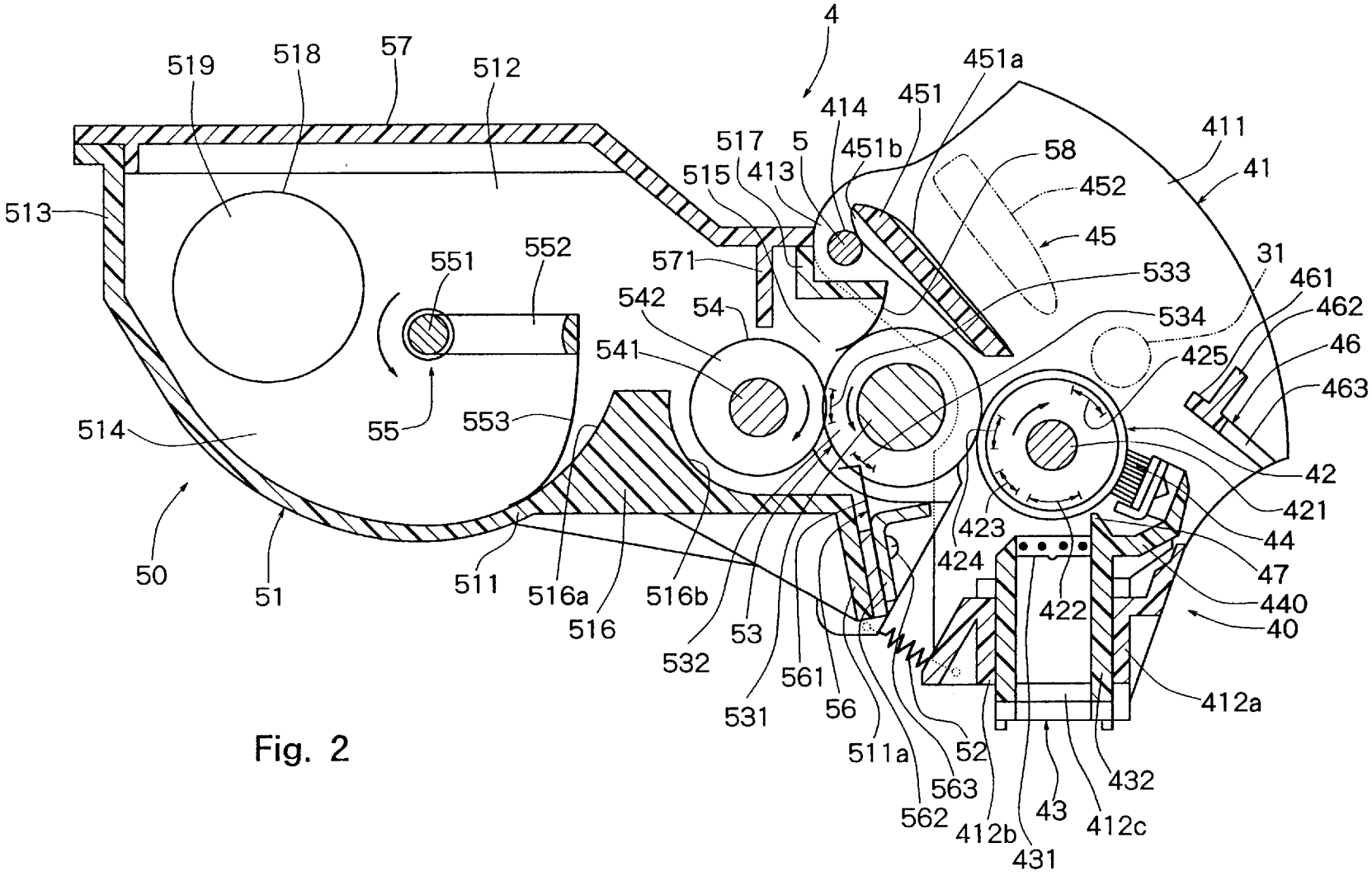
FIG. 2 is a sectional view of a process unit that is mounted on the image-forming machine shown in FIG. 1.

The process unit 4, as shown in FIG. 2, has a photosensitive unit 40 and a developing unit 50 pivotably supported by the photosensitive unit 40 via a support shaft 5. The photosensitive unit 40 has a photosensitive unit support means 41. The photosensitive unit support means 41 has a pair of side wall members 411 (FIG. 2 shows the side wall member of the back side only) arranged at a distance in the back-and-forth direction, and coupling members 412*a* and 412*b* for coupling the lower portions of the pair of side wall members 411 together. The coupling members 412*a* and 412*b* have inner surfaces opposed to each other in parallel, between which is formed a space 412*c* for mounting a charging means that will be described later. The space 412*c* for mounting the charging means is located to be opposed to a charging zone that will be described later. The thus constituted photosensitive unit support means 41 is formed as a unitary structure by molding a plastic material. Support portions 413 having mounting holes 414 are provided at the upper end portions of the pair of side wall members 411 constituting the photosensitive unit support means 41 on the side of the developing unit 50. By inserting a support shaft 5 which is a metal rod disposed in a developing housing that will be described later of the developing unit 50 in the mounting holes 414 of the support portions 413, the photosensitive unit 40 and the developing unit 50 are supported pivotably relative to each other.

The photosensitive unit 40 has a photosensitive drum 42 having a photosensitive layer formed on the peripheral surface thereof. The photosensitive drum 42 has a rotary shaft 421 rotatably supported by the pair of side wall members 411 constituting the photosensitive unit support means 41, and is rotated by a drive means that is not shown in a direction of an arrow to pass successively through a charging zone 422, an electrostatic latent image-forming zone 423, a developing zone 424 and a transfer zone 425. In space 412*c* for mounting the charging means located in the charging zone 422 is mounted a charging means 43 that is opposed to the peripheral surface of the lower side of the photosensitive drum 42. The charging means 43 includes a corona discharger 431 arranged in parallel with the photosensitive drum 42 along the axial direction and working as a charger, and a charger-holding member 432 made of a plastic material to hold the corona discharger. The charging means 43 is placed in the predetermined position when the charger-holding member 432 is fitted to the space 412*c* for mounting the charging means. Between the charging zone 422 and the transfer zone 425 is disposed a foreign matter-recovering brush 44 in contact with the peripheral surface of the photosensitive drum 42 and along the axial direction of the photosensitive drum 42. The paper dust-recovering brush 44 is made of an acrylic fiber or the like, has nearly the same length as the length of the photosensitive drum 42 in the axial direction thereof, molded as a unitary structure with the charger-holding member 432, and is mounted on a brush support member 440 disposed along the axial direction of the photosensitive drum 42. The upper end of the charger-holding member 432 is so protruded as to approach the peripheral surface of the photosensitive drum 42 between the corona discharger 431 for electric charging disposed in the charging zone 422 and the foreign matter-recovering brush 44, thereby to constitute a wall 47 for preventing the infiltration of the toner. The residual toner on the peripheral surface of the photosensitive drum 42 is removed together with foreign matters such as paper dust by the foreign matter-recovering brush 44. However, when the residual toner is not reliably trapped by the foreign matter-recovering brush 44 but falls, the wall 47 works to prevent the toner from infiltrating into the corona discharger 431 for electric charging.

Figure 3:
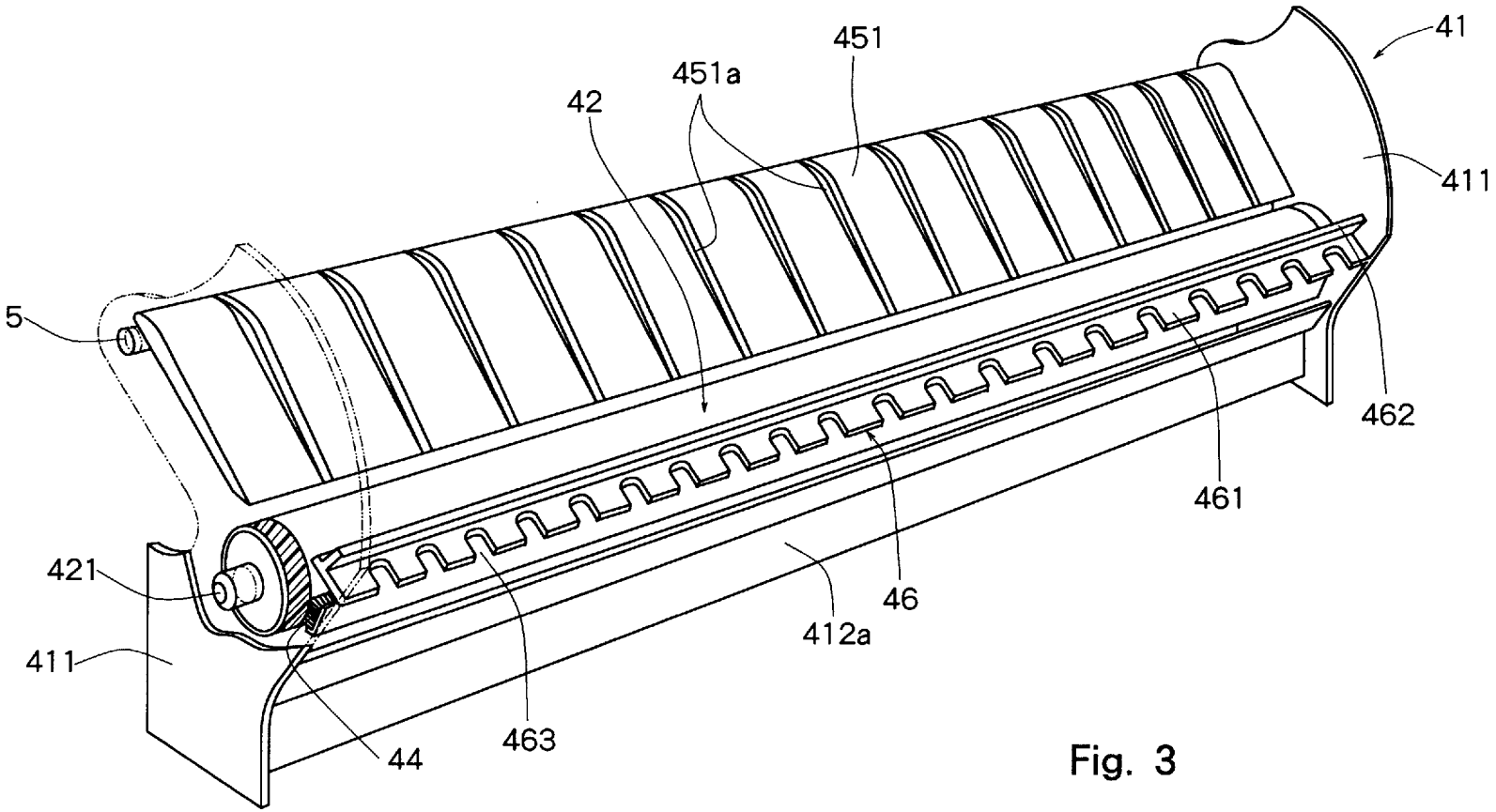
FIG. 3 is a perspective view illustrating a major portion of a photosensitive unit constituting the process unit of FIG. 2.

Between the pair of side wall members 411 constituting the photosensitive unit support means 41, there is disposed a lower guide plate 451 constituting one of a pair of pre-transfer guide plates 45 for guiding a transfer paper, which is fed from the upper left side in FIG. 2, toward the transfer zone 425 on the peripheral surface of the photosensitive drum 42. The lower guide plate 451 is molded integrally with the pair of side wall members 411. On the upper surface of the lower guide plate 451 are integrally formed a plurality of guide ribs 451*a* at space intervals in the lengthwise direction as shown in FIG. 3 (in a direction perpendicular to the surface of the paper in FIG. 2). The lower guide plate 451 further has, integrally formed on the lower surface thereof, a plurality of reinforcing ribs 451*b* at space intervals in the lengthwise direction thereof (direction perpendicular to the surface of the paper in FIG. 2), the reinforcing ribs 451*b* being in contact with the support shaft 5. Even when a pushing force is exerted on the upper surface, therefore, the lower guide plate 451 is prevented from being deflected since the reinforcing ribs 451*b* come into contact with the support shaft 5. Moreover, the lower guide plate 451 works as a coupling member for coupling together the upper portions of the pair of side wall members 411 constituting the photosensitive unit support means 41, and contributes to enhancing the rigidity of the photosensitive unit support means 41. In the illustrated embodiment, furthermore, the lower guide plate 451 is integrally formed on the pair of side wall members 411, and precisely maintains a positional relationship with respect to the photosensitive drum 42 that is rotatably supported by the pair of side wall members 411. In the illustrated embodiment, furthermore, the lower guide plate 451 also works as a member for preventing the contact with the photosensitive layer on the photosensitive drum 42 when the process unit is being attached or detached, works as a member for preventing the developing unit 50 from coming into contact with a developing roller that will be described later, and works to prevent the toner scattered from the surface of the developing roller from adhering onto the transfer paper or on the passage for conveying the transfer paper.

Between the pair of side wall members 411 constituting the photosensitive unit support means 41 is disposed a guide plate 46 for guiding the transfer paper, on which the toner image is transferred in the transfer zone 425, to a fixing means that will be described later, the guide plate 46 being integrally formed on the pair of side wall portions 411.

Therefore, the guide plate 46 works as a coupling member for coupling together the pair of side wall portions 411 that constitute the photosensitive unit support means 41, and enhances the rigidity of the photosensitive support means 41. The guide plate 46 in the illustrated embodiment includes a transfer paper guide portion 461 of which the lower surface works as a transfer paper guide surface, and a reinforcing portion 462 formed on the upper surface of the transfer paper guide portion 461 nearly perpendicularly thereto over the whole length in the lengthwise direction. The transfer paper guide portion 461 is provided with a plurality of openings 463 along its length as shown in FIG. 3 (in a direction that runs across the width of the surface of the paper in FIG. 2). The plurality of openings 463 have ends on the downstream side in the direction of conveying the transfer paper, which reach the end of the transfer paper guide portion 461 on the downstream side in the direction of conveying the transfer paper, and are opened. The plurality of openings 463 formed in the transfer paper guide portion 461 constituting the guide plate 46 work to release the hot air heated by the fixing means that will be described later. The plurality of openings 463 are open at the end on the downstream side in the direction of conveying the transfer paper, and have no edge. Therefore, the transfer paper is smoothly guided along the lower surface of the transfer paper guide portion 461 without being caught at its leading end by the open edges. This makes it possible to prevent the occurrence of paper jamming that is caused when the leading end of the transfer paper is caught by the open edges.

Figure 5:
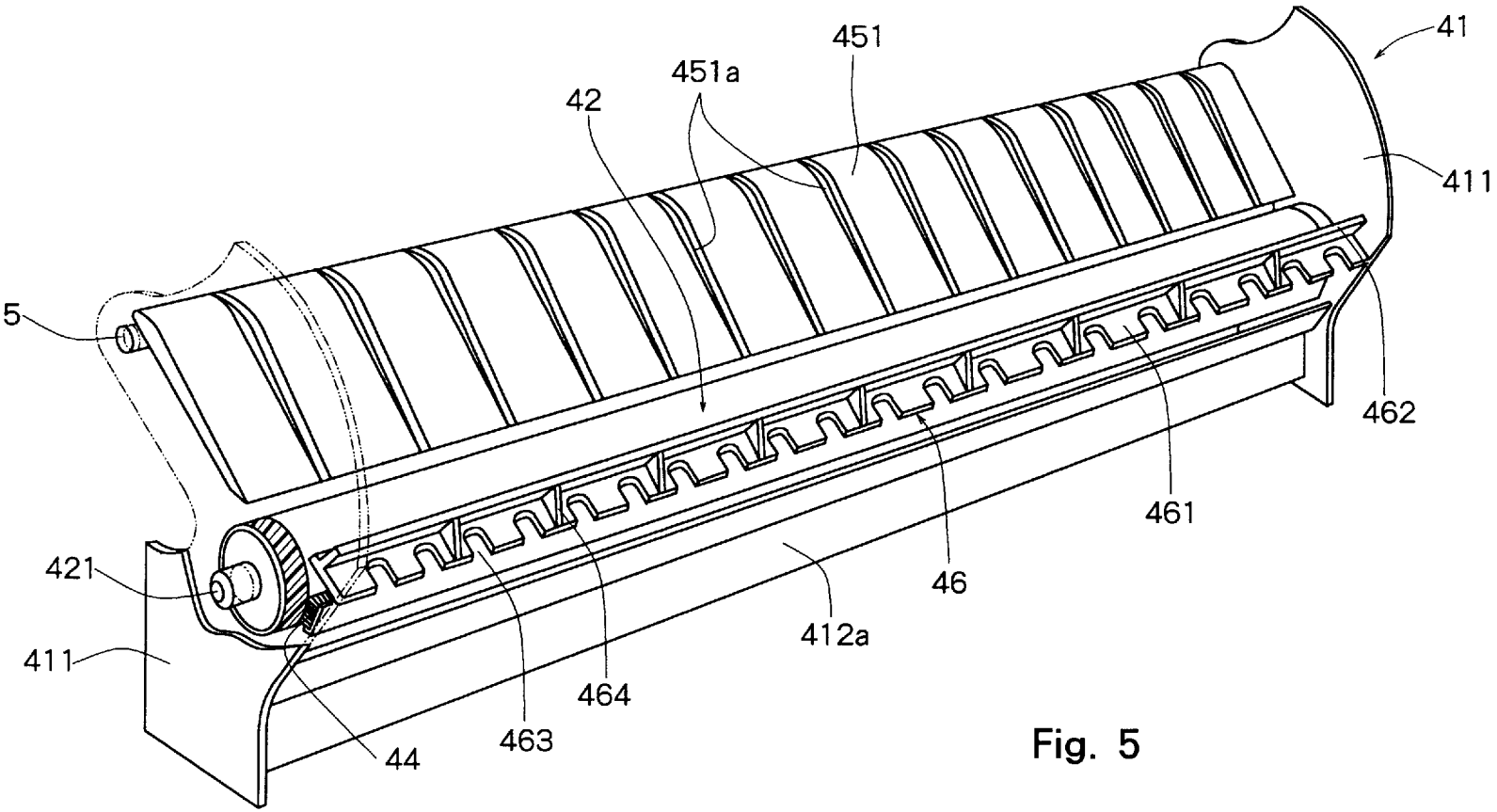
FIG. 5 is a perspective view illustrating a major portion of the photosensitive unit constituting the process unit of FIG. 2 according to another embodiment.

Next, described below with reference to FIG. 5 is the guide plate 46 for guiding the transfer paper, onto which the toner image is transferred, to the fixing means according to another embodiment. In the illustrated embodiment, on the upper surface of the transfer paper guide portion 461 constituting the guide plate 46 are formed a plurality of ribs 464, spaced at intervals, in the lengthwise direction. The plurality of ribs 464 having a triangular shape are provided among the openings 463 from the reinforcing portion 462 toward the downstream end in the direction of conveying the transfer paper. The plurality of ribs 464 formed on the upper surface of the transfer paper guide portion 461 constituting the guide plate 46, compensate for a decrease in the rigidity of the transfer paper guide portion 461 caused by the formation of the plurality of openings 463. Thus, the rigidity of the transfer paper guide portion 461 is maintained, the precision for guiding the transfer paper is maintained, and deformation due to heat is prevented.

Next, described below is the developing unit 50 which works as a device for developing electrostatic latent image. The developing unit 50 in the illustrated embodiment is equipped with a developing housing 51 which contains a developing agent comprising a one-component toner. The developing housing 51 is constituted by a bottom wall 511, a front side wall and a rear side wall 512 (the rear side wall only is shown in FIG. 2) erected upright from the front and rear ends (ends in a direction perpendicular to the surface of the paper in FIG. 2) of the bottom wall 511, and a left side wall 513. These walls are integrally formed by molding a plastic material, and define a stirrer chamber 514 and a developing chamber 515. On the bottom wall 511 constituting the developing housing 51 is integrally formed a partitioning wall 516 in the back-and-forth direction (direction perpendicular to the surface of the paper in FIG. 2) between the stirrer chamber 514 and the developing chamber 515. Both the right and left surfaces of the partitioning wall 516 are formed as arcuate guide surfaces 516*a* and 516*b*. Between the front and rear side walls 512 constituting the developing housing 51 is provided a coupling member 517 at an upper part on the side of the developing chamber 515, integrally with the front and rear side walls 512. A toner supply hole 518 is formed in the rear side wall 512 constituting the developing housing 51, and is fitted with a cap 519. At an upper end portion on the side of the developing chamber 515 of the thus constituted developing housing 51 is disposed the support shaft 5 penetrating through the front and rear side walls 512. Both ends of the support shaft 5 are fitted to mounting holes 414 formed in the support portions 413 of the pair of side wall members 411 constituting the support means 41 for supporting the photosensitive unit 40, so that the photosensitive unit 40 and the developing unit 50 are supported pivotably relative to each other. Coil springs 52 forming resilient means are interposed between the front end at the lower part of the support means 41 for supporting the photosensitive unit 40 and the rear end at the lower part of the developing housing 51. Due to these coil springs 52, the photosensitive unit support means 41 and the developing housing 51 are pulled toward each other with the support shaft 5 as a fulcrum. The developing housing 51 is open at its upper side and right side, i.e., is open on the side of the photosensitive unit 40.

In the developing housing 51 are arranged a developing roller 53, a feeding roller 54, a stirrer means 55 and a developing agent-limiting means 56.

The developing roller 53 is disposed in the developing chamber 515 of the developing housing 51, and includes a rotary shaft 531 rotatably mounted on the front and rear side walls 512 constituting the developing housing 51, and a solid synthetic rubber roller 532 secured to the outer peripheral surface of the rotary shaft 531. The rotary shaft 531 can be formed of a suitable metallic material such as stainless steel. The solid synthetic rubber roller 532 is composed of a relatively soft and electrically conductive material such as an electrically conductive solid synthetic rubber like an urethane rubber. In the illustrated embodiment, the solid synthetic rubber roller 532 has a surface roughness on the peripheral surface thereof, i.e., has a 10-points average roughness Rz of from 5.0 to 12.0 as measured in compliance with JIS B 0601. Furthermore, the solid synthetic rubber roller 532 has a volume resistivity of from about $10^4$ to about $10^9$ Ω·cm. In the illustrated embodiment, furthermore, the solid synthetic rubber roller 532 has a roller hardness or Asker's C hardness of from 60 to 80. The thus constituted roller 532 of the developing roller 53 is exposed through the right-side opening formed in the developing housing 51, and is positioned being opposed to the photosensitive drum 42. The peripheral surface of the roller 532 constituting the developing roller 53 is pressed against the peripheral surface of the photosensitive drum 42 in the developing zone. In the thus pressed nipping portion, the peripheral surface of the roller 532 is elastically compressed to some extent. The rotary shaft 531 of the developing roller 53 is driven by a drive means which is not shown in the direction of an arrow, i.e., from the lower side toward the upper side in the developing zone where the roller 532 and the photosensitive drum 42 are in contact with each other. With the rotation of the rotary shaft 531, the roller 532 is rotated in the direction of arrow, too, so that the peripheral surface of the roller 532 moves successively through a developing agent-holding zone 533, a developing agent-limiting zone 534 and a developing zone 424. In the illustrated embodiment, a constant voltage of 300 V is applied to the rotary shaft 531 of the developing roller 53.

The feeding roller 54 is disposed in the developing chamber 515 of the developing housing 51 in parallel with the developing roller 53, and includes a rotary shaft 541 rotatably mounted on the front and rear side walls 512 constituting the developing housing 51 and a roller 542 secured to the outer peripheral surface of the rotary shaft 541. Like the rotary shaft 531 of the developing roller 53, the rotary shaft 541 can be formed of a suitable metallic material such as stainless steel. The roller 542 is made of a foamed material such as foamed silicone or foamed urethane. The roller 542 is pressed against the roller 532 of the developing roller 53 in the developing agent-holding zone 533 where the roller 542 and the developing roller 53 are nipping together. It is desired that the hardness of the foamed material constituting the roller 542 of the feeding roller 54 is considerably smaller (e.g., Asker's C hardness of about 35) than the hardness of the roller 532 constituting the developing roller 53, and that the roller 542 is elastically compressed by about 0.1 to 0.6 mm in the nipping region by pressing the roller 542 against the roller 532 of the developing roller 53. The roller 542, too, has electrically conductive property and has a volume resistivity of about $10^2$ to $10^6$ Ω·cm. The rotary shaft 541 of the feeding roller 54 is driven by a drive means that is not shown in a direction indicated by an arrow, i.e., from the upper side toward the lower side in the developing agent holding zone 533 where the roller 542 and the roller 532 of the developing roller 53 are nipping together. With the rotation of the rotary shaft 541, the roller 542 is rotated in the direction indicated by arrow. In the illustrated embodiment, the rotary shaft 541 of the feeding roller 54 is applied with a constant voltage of 450 V which is higher than the voltage applied to the developing roller 53.

There exists a relationship V1<V2<V3 among the peripheral velocity V1 of the photosensitive drum 42, peripheral velocity V2 of the developing roller 53, and peripheral velocity V3 of the feeding roller 54. In the illustrated embodiment, a relationship 1.2 V1≦V2≦2.5 V1 is maintained between the peripheral velocity V1 of the photosensitive drum 42 and the peripheral velocity V2 of the developing roller 53, and a relationship 1.0 V2≦V3≦2.0 V2 is maintained between the peripheral velocity V2 of the developing roller 53 and the peripheral velocity V3 of the feeding roller 54. When the peripheral velocity V2 of the developing roller 53 becomes smaller than 1.2 V1, the developing agent is not sufficiently supplied to the photosensitive drum 42 and the image density decreases. When the peripheral velocity V2 of the developing roller 53 becomes smaller than 1.2 V1, furthermore, the scraping action of the developing roller 53 decreases against the developing agent that is not transferred but remains adhered onto the photosensitive drum 42 after the transfer operation. Without the developing agent being transferred or removed from the photosensitive drum 42, there occurs a so-called offset fogging. When the peripheral velocity V2 of the developing roller 53 becomes greater than 2.5 V1, on the other hand, the developing roller 53 is driven requiring an increased torque, and the developing agent scatters due to a centrifugal force. When the peripheral velocity V3 of the feeding roller 54 becomes smaller than 1.0 V2, the developing agent is not sufficiently supplied to the developing roller 53 and the image density decreases. When the peripheral velocity V3 of the feeding roller 54 becomes smaller than 1.0 V2, furthermore, only a small scraping action is produced by the feeding roller 54 for the peripheral surface of the developing roller 53. In case the developing agent which has not been transferred but remains adhered to the photosensitive drum 42 after the transfer operation, adheres to the developing roller 53, therefore, it becomes difficult to remove the developing agent; i.e., the developing agent that remains adhered becomes a cause of so-called ghost phenomenon that appears in the developing the next time. When the peripheral velocity V3 of the feeding roller 54 becomes greater than 2.0 V2, on the other hand, the feeding roller 54 is driven requiring an increased torque, the developing agent tends to stay on the upper side of a portion where the feeding roller 54 and the developing roller 53 are nipping together, resulting in an insufficient supply of the developing agent to the developing roller 53.

A stirrer means 55 is disposed in the stirrer chamber 514 of the developing housing 51. The stirrer means 55 is disposed in parallel with the feeding roller 54, and includes a rotary shaft 551 rotatably mounted on the front and rear side walls 512 constituting the developing housing 51, a stirrer member 552 secured to the rotary shaft 551, and an elastic stirrer sheet member 553 mounted on the stirrer member 552. The stirrer member 552 is formed of a plastic material, and has a plurality of openings in the lengthwise direction (direction perpendicular to the surface of the paper in FIG. 2). The stirrer sheet member 553 is formed of a polyethylene terephthalate (PETP) resin having flexibility, and is secured with an adhesive to the front edge of the stirrer member 552. The thus constituted stirrer means 55 is continuously rotated by a drive means that is not shown in a direction indicated by an arrow in FIG. 2.

The developing agent-limiting means 56 has a flexible and elastic blade 561 that is contacted under pressure to the peripheral surface of the roller 532 constituting the developing roller 53. The blade 561 is made of a stainless steel plate or a spring steel plate which is, for example, about 0.1 to 0.2 mm thick, and has nearly the same size as the length of the roller 532 constituting the developing roller 53 in the lengthwise direction. The blade 561 is mounted at its base end part on a blade-mounting portion 511*a* provided at the open end of the bottom wall 511 constituting the developing housing 51 on the side of the photosensitive unit 40. The base end part of the blade 561 is sandwiched between the blade-mounting portion 511*a* and a holder plate 562, and is fixed thereto by screws 563. The front end of the blade 561 is bent, and this bent portion is contacted under pressure to the peripheral surface of the roller 532 constituting the developing roller 53 in the developing agent-limiting zone 534.

A closure 57 is mounted on the developing housing 51 for covering the open top thereof. The closure 57 is made of a plastic material, and is secured with an adhesive to the upper surfaces of the front and rear side walls 512, left side wall 513 and coupling member 517 that constitute the developing housing 51. On the inner surface of the closure 57, a limiting portion 571 is integrally formed at a position opposed to the feeding roller 54 to extend in the back-and-forth direction (direction perpendicular to the surface of the paper in FIG. 2) and to protrude toward the developing chamber 515. A predetermined gap is maintained between the lower end of the limiting portion 571 and the outer peripheral surface of the roller 542 constituting the feeding roller 54. In the illustrated embodiment, a sheet-like sealing member 58 is mounted on the coupling member 517 constituting the developing housing 51. The sheet-like sealing member 58 is constituted by a flexible sheet member formed of, for example, a polyethylene terephthalate (PETP) and has nearly the same length as that of the roller 532 constituting the developing roller 53 in the axial direction thereof. The sheet-like sealing member 58 is secured at its one end portion to the coupling member 517 by a securing means such as an adhesive, and is curved at its other end portion and is brought into resilient contact with the peripheral surface of the roller 532 constituting the developing roller 53. The thus constituted sheet-like sealing member 58 prevents the developing agent from scattering through the opening of the developing housing 51 on the side of the photosensitive unit 40 in cooperation with the blade 561 of the developing agent-limiting means 56.

As shown in FIG. 1, the thus constituted process unit 4 is detachably mounted on the machine housing 20 of the printer 2. That is, by turning the cover 23 constituting the machine housing 20 of the printer 2 counterclockwise on the shaft 22 in FIG. 1, the upper side of the housing body 21 constituting the machine housing 20 is opened. Then, the process unit 4 is mounted in the housing body 21 from the upper side. In the housing body 21 is provided a positioning means (not shown) capable of placing the photosensitive unit 40 of the process unit 4 at a predetermined position. After the process unit 4 is mounted in the housing body 21 of the machine housing 20, the cover 22 is turned clockwise on the shaft 22 in FIG. 1, thereby to close the upper portion thereof.

Referring to FIG. 1, a laser unit 24 is disposed at the lower part of the housing body 21 which constitutes the machine housing 20 of the printer 2. The laser unit 24 projects a laser beam corresponding to print data from, for example, a word processor connected to the printer 2, onto the photosensitive layer of the photosensitive drum 42 in the electrostatic latent image-forming zone 423 in the process unit 4, thereby to form an electrostatic latent image.

In the housing body 21 constituting the machine housing 20 of the printer 2 is disposed a pair of fixing rollers 25 that constitute a fixing means on the downstream side of the guide plate 46. The pair of fixing rollers 25 are constituted by a heating roller 251 containing a heating means and a pressing roller 252 disposed in contact with the peripheral surface of the heating roller 251. As shown in FIG. 1, the pressing roller 252 is disposed in contact with the heating roller 251 on the downstream side of a vertical line passing through the axis of the heating roller 251 in the direction of conveying the transfer paper and, hence, space is formed over the heating roller 251. The guide plate 46 is arranged extending up to space formed above the heating roller 251. In the illustrated embodiment as described above, the pressing roller 252 is disposed on the downstream side of the vertical line passing through the axis of the heating roller 251 in the direction of conveying the transfer paper, and the guide plate 46 is disposed extending up to space formed above the heating roller 251. Therefore, space formed over the heating roller 251 is utilized for arrangement, making it possible to decrease the size of the image-forming machine in the back-and-forth direction (right-and-left direction in FIG. 1). When the guide plate 46 is arranged to extend up to the upper side of the heating roller 251, the hot air heated by the heating roller 251 may stay between the heating roller 251 and the guide plate 46. In the illustrated embodiment, however, a plurality of openings 463 are formed in the transfer paper guide portion 461 that constitutes the guide plate 46, enabling the hot air to smoothly escape.

Figure 4:
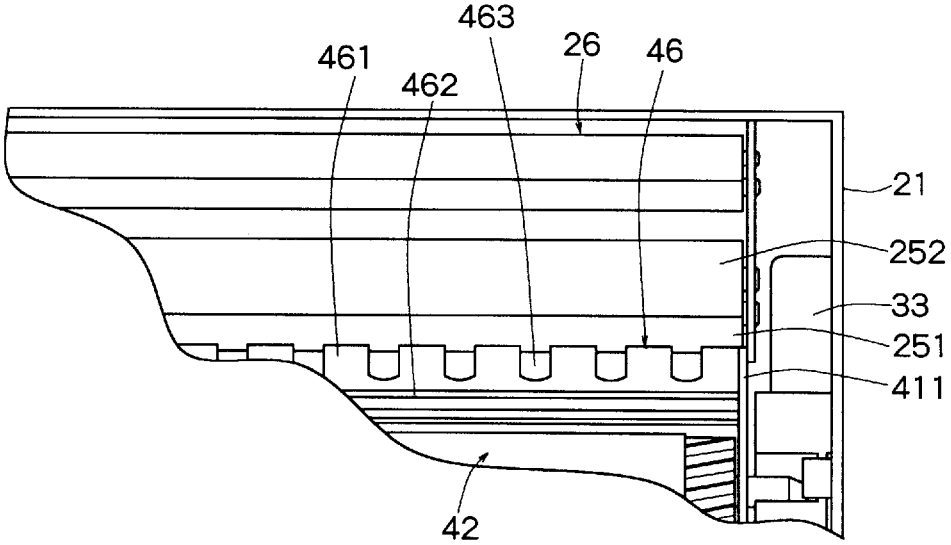
FIG. 4 is a plan view illustrating a major portion of the image-forming machine shown in FIG. 1.

A pair of discharge rollers 26 are disposed on the downstream side of the pair of fixing rollers 25, and a paper discharge tray 27 is disposed on the downstream side of the pair of discharge rollers 26. According to the embodiment as shown in FIG. 4, a cooling fan 33 is disposed at the side (right side in FIG. 4) of the pair of fixing rollers 25 on the front side of the housing body 21. The cooling fan 33 blows cooling air from the front side toward the back side of the pair of fixing rollers 25 to cool the surroundings of the pair of fixing rollers 25.

Referring to FIG. 1, on the left upper part of the cover 23 constituting the machine housing 20 of the printer 2 is disposed a paper feed tray 28 on which will be placed the transfer papers. A paper feed roller 29 is disposed on the downstream side of the paper feed tray 28, and is driven by a drive means that is not shown in a direction indicated by an arrow in FIG. 1. A friction pad 30 for separating the paper is disposed being opposed to the paper feed roller 29. In the transfer zone 422, furthermore, a non-contact type transfer roller 31 is disposed being opposed to the photosensitive drum 42. The transfer roller 31 is formed of an electrically conductive foamed urethane and is rotatably supported by the cover 23. The transfer roller 31 has, at its both ends, collars (not shown) made of an insulating material such as a plastic material having an outer diameter larger than that of the transfer roller 31, the collars being brought into contact with the peripheral surface of the photosensitive drum 42. Therefore, the transfer roller 31 is driven in a slipping manner with the rotation of the photosensitive drum 42. A gap of about 0.5 mm is maintained between the peripheral surface of the transfer roller 31 and the peripheral surface of the photosensitive drum 42. A constant current of, for example, 10 $\mu$A is permitted to flow into the thus constituted transfer roller 31. Furthermore, an upper guide plate 452 constituting the other one of the pair of pre-transfer guide plates 45 is disposed in the cover 23.

The printer 2 in the illustrated embodiment is constituted as described above. The actions will now be described.

Based on a print command from a word processor or the like that is not shown, the above-mentioned members start operating, and the photosensive layer on the surface of the photosensitive drum 42 is charged substantially uniformly to a predetermined polarity by the corona discharger 43 for electric charging. Then, a laser beam of the laser unit 24 corresponding to the print data from the word processor or the like, is projected onto the surface of the charged photosensitive layer of the photosensitive drum 42, thereby to form an electrostatic latent image. The electrostatic latent image thus formed on the photosensitive layer of the photosensitive drum 42 is developed into a toner image by the developing action of the developing unit 50. The developing action of the developing unit 50 will be described later in detail. The transfer papers placed on the paper feed tray 28 are fed piece by piece by the action of the paper feed roller 29 and of the friction pad 30. The transfer paper is guided by the pair of pre-transfer guide plates 45, conveyed to between the photosensitive drum 42 and the transfer roller 31, and the toner image formed on the photosensitive drum 42 is transferred onto the surface of the transfer paper.

The transfer paper onto which the toner image is transferred is guided by the guide plate 46 and is conveyed to the pair of fixing rollers 25. The transfer paper onto which the toner image is heat-fixed by the pair of fixing rollers 25 is discharged by the pair of discharge rollers 26 onto the paper discharge tray 27. Heat radiated from the heating roller 251 for heat-fixing the toner image that has been transferred onto the transfer paper, is absorbed by the cooling air blown by the cooling fan 33 and is released through a ventilation port formed on the back side of the housing body 21. As described above, the cooling air is blown by the cooling fan 33 to absorb heat radiated to the surroundings from the heating roller 251, and is discharged out of the housing body 21, so that parts arranged around the heating roller 251 will not be overheated. Here, however, unless the cooling fan 33 has a considerably large ability, heat accumulated under the guide plate 46 which is disposed on the heating roller 251 is not sufficiently removed by the cooling air. According to the present invention, however, the transfer paper guide portion 461 constituting the guide plate 46 is provided with a plurality of openings 461 in the direction of width. Therefore, heat built up under the guide plate 46 escapes upwards through the plurality of openings 461, and is absorbed by the cooling air and is released out of the housing body 21, making it possible to efficiently cool even the lower side of the guide plate 46 after the transfer operation. As a result, even in the constitution in which the photosensitive drum and the fixing means are arranged being close to each other as in the illustrated embodiment, properties of the photosensitive material are not deteriorated by a rise in the temperature of the photosensitive drum and the toner is prevented from melt-adhering to the surface of the drum. Moreover, it is allowed to prevent deformation of the housing or of the guide plate due to heat, making it possible to maintain positional precision, and to prevent the transfer paper from being caught. The plurality of openings 463 are formed at the end on the downstream side in the direction of conveying the transfer paper and have no edges. Therefore, the end of the transfer paper guided along the lower surface of the transfer paper guide portion 461 is not caught by the edges of the openings, enabling the transfer paper to be smoothly guided. Since the end of the transfer paper is not caught by the edges of the openings, it is allowed to prevent the occurrence of paper jamming.

When the peripheral surface of the photosensitive drum 42 that has passed through the transfer zone 425 passes through the foreign matter-recovering brush 44, foreign matters such as paper dust adhered to the peripheral surface are removed by the foreign matter-recovering brush 44. At this moment, residual toner adhered to the peripheral surface of the photosensitive drum 42 is removed, too, together with foreign matters such as paper dust. The residual toner that has been removed may not often be reliably trapped by the foreign matter-recovering brush 44 but may fall. The toner that has fallen and deposited on the corona discharger 431 for electric charging, could become a cause of irregular charging. In the illustrated embodiment, however, the toner that has fallen is prevented from infiltrating into the corona discharger 431 for electric charging owing to the wall 47 for preventing the infiltration of toner.

The developing action of the developing unit 50 will be described next.

Upon starting the operation of the developing unit 50, the developing roller 53, feeding roller 54 and stirrer means 55 are rotated by a drive means that is not shown in the directions indicated by arrows. By rotating the stirrer member 552 and the stirrer sheet member 553 constituting the stirrer means 55 in the direction indicated by an arrow, the developing agent contained in the stirrer chamber 514 is stirred and is fed into the developing chamber 514 from the upper side of the feeding roller 54 climbing over the partitioning wall 516. Here, the limiting member 571 formed on the inner surface of the closure 57 so works that the developing agent will not be supplied in excess amounts into the developing chamber 514. The developing agent fed by the stirrer means 55 rides on the roller 542 of the feeding roller 54 and is conveyed to a nipping portion which is the developing agent-holding zone 533 where the roller 542 and the roller 532 of the developing roller 53 are nipping together. The feeding roller 54 and the developing roller 53 rotate in the same direction from the upper side toward the lower side in the developing agent-holding zone 533 which is the nipping portion. Therefore, the developing agent is sufficiently supplied from the feeding roller 54 to the developing roller 53, and does not become in short supply. Besides, the feeding roller 54 and the developing roller 53 rotate in the same direction in the developing agent-holding zone 533 which is the nipping portion as described above, and is reliably rotated without requiring a large driving force.

The developing agent conveyed to the developing agent-holding zone 533 which is a portion where the feeding roller 54 and the developing roller 53 are nipping as described above, is held by the peripheral surface of the roller 532 that constitutes the developing roller 53 and is conveyed toward the developing agent-limiting zone 534. Here, the feeding roller 54 and the developing roller 53 rotate in the same direction from the upper side toward the lower side in the developing agent-holding zone 533 which is the nipping portion. Accordingly, the developing agent passes through the portion where the above two rollers are nipping together, held by the developing roller 53, and is conveyed to the developing agent-limiting zone 534 and to the developing zone 424. Thus, the developing agent is rubbed as it passes through the nipping portion and is electrically charged to a sufficient degree, making it possible to prevent the occurrence of so-called fogging.

In the developing agent-limiting zone 534, the blade 561 of the developing agent-limiting means acts on the developing agent held on the peripheral surface of the roller 532 of the developing roller 53, so that the amount of the developing agent held on the peripheral surface of the roller 532 is limited to form a thin layer thereof. In the developing agent-limiting zone 534, the developing agent is limited by the blade 561 of the developing agent-limiting means 56 and is scraped off onto the bottom wall 511 of the developing housing 51. Here, since the feeding roller 54 is rotating in a direction indicated by an arrow, the developing agent continues to be conveyed along the guide surface 516*b* of the partitioning wall 516.

As described above, the developing agent is held on the peripheral surface of the roller 532 constituting the developing roller 53 in the developing agent-holding zone 533 and is formed into a thin layer in the developing agent-limiting zone 534 by the action of the blade 561 of the developing agent-limiting means 56. The developing agent is then conveyed to the developing zone 424 with the rotation in the direction of arrow.

In the developing zone 424, the developing agent is applied to the electrostatic latent image on the electrostatic material disposed on the peripheral surface of the photosensitive drum 42, whereby the electrostatic latent image is developed into toner image. For example, the electrostatic latent image has a non-image region charged to about +600 V and an image region charged to about +120 V, and the toner which is the developing agent is adhered to the image region (so-called reversal development). The photosensitive drum 42 and the developing roller 53 are rotated in the directions indicated by arrows in FIG. 2. In the developing zone 424, therefore, the peripheral surface of the photosensitive drum 42 and the peripheral surface of the roller 532 constituting the developing roller 53 are both moved in the same direction from the lower side toward the higher side. The peripheral velocity V2 of the roller 532 and the peripheral velocity V1 of the photosensitive drum 42 have been so set as to maintain a relationship $1.2\ V1 \leqq V2 \leqq 2.5\ V1$. The developing agent is conveyed in a sufficient amount to the developing zone 424 by the roller 532 of the developing roller 53, and the developing agent once adhered to the non-image portion of the electrostatic latent image is suitably peeled off due to the rubbing action of the peripheral surface of the roller 532 against the peripheral surface of the photosensitive drum 42. It is therefore allowed to obtain a good toner image having a suitable developing density without fogging. On the other hand, the used developing agent that has passed through the developing zone 424 while being held on the peripheral surface of the roller 532 constituting the developing roller 53, is transferred onto the surface of the feeding roller 54 at a portion where the developing roller 53 and the feeding roller 54 are nipping together. Here, the peripheral velocity of the feeding roller 54 is greater than the peripheral velocity of the developing roller 53. In order to migrate the developing agent at the nipping portion, therefore, the adhering force of the non-transferred developing agent adhered to the developing roller 53 is weakened at the time when it passes through the developing zone 424, and the non-transferred developing agent is recovered. Thus, it is made possible to prevent the occurrence of so-called ghost caused by the non-transferred developing agent that remains adhered to the developing roller 53.

The present invention was described above by way of embodiments of when being adapted to a printer. The invention, however, is in no way limited to the illustrated embodiments only but can be adapted to, for example, an electrostatic copier, and can be varied or modified in a variety of ways without departing from the technical spirit and scope of the invention.

The image-forming machine and the process unit for the image-forming machine according to the present invention are constituted as described above, and exhibit actions and effects as described below.

That is, according to the present invention, the guide plate is provided with a plurality of openings in the lengthwise direction and guides the transfer paper, onto which the toner image is transferred, to the fixing means. Therefore, heat built up under the guide plate after the transfer operation escapes upwards through the plurality of openings, and is absorbed by cooling air blown by the cooling fan and is released out of the machine. Accordingly, the lower side of the guide plate is effectively cooled even after the transfer operation.

What we claim is:

1. An image-forming machine comprising:

a photosensitive drum rotatably disposed;

a charger for electrically charging a peripheral surface of said photosensitive drum to a predetermined polarity;

a developer for developing an electrostatic latent image on said peripheral surface of said photosensitive drum into a toner image;

a transfer means for transferring the toner image formed on said peripheral surface of said photosensitive drum onto a transfer paper;

a fixing means for heat-fixing the toner image transferred onto the transfer paper by said transfer means;

a cooling fan for blowing cooling air to the surrounding of said fixing means; and a guide plate for guiding the transfer paper, onto which the toner image is transferred by said transfer means, to said fixing means, said guide plate having a length in a direction that is substantially perpendicular to a conveying direction of the transfer paper guided by said guide plate, said guide plate having a side edge, said side edge defining a plurality of openings along said length of said guide plate.

2. The image-forming machine according to claim 1, wherein said guide plate includes a plurality of ribs, spaced at intervals, along said length of said guide plate.

3. An image-forming machine comprising:

a photosensitive drum rotatably disposed;

a charger for electrically charging a peripheral surface of said photosensitive drum to a predetermined polarity;

a developer for developing an electrostatic latent image on said peripheral surface of said photosensitive drum into a toner image;

a transfer means for transferring the toner image formed on said peripheral surface of said photosensitive drum onto a transfer paper;

a fixing means having a heating roller for heat-fixing the toner image transferred onto the transfer paper by said transfer means and a pressing roller disposed on an upper side of said heating roller in contact therewith, said pressing roller being disposed in contact with said heating roller on a downstream side of a vertical line passing through an axis of said heating roller in the direction of conveying the transfer paper;

a cooling fan for blowing cooling air to the surrounding of said fixing means; and a guide plate for guiding the transfer paper, onto which the toner image is transferred by said transfer means, to said fixing means, said guide plate being disposed between said transfer means and said fixing means, said guide plate extending up to said upper side of said heating roller, and said guide plate plate having a length in a direction that is substantially perpendicular to a conveying direction of the transfer paper guided by said guide plate, said guide plate having a side edge, said side edge defining a plurality of openings along said length of said guide plate.

4. The image-forming machine according to claim 3, wherein said guide plate includes a plurality of ribs, spaced at intervals, along said length of said guide plate.

5. A process unit for an image-forming machine, which can be detachably attached to a machine housing having a fixing means and a cooling fan for blowing cooling air to the surrounding of said fixing means, said process unit comprising:

a photosensitive drum rotatably disposed to successively pass through a charging zone, an electrostatic latent image-forming zone, a developing zone and a transfer zone;

a charger disposed in said charging zone for electrically charging a peripheral surface of said photosensitive drum to a predetermined polarity;

a developer disposed in said developing zone for developing into a toner image an electrostatic latent image formed on said peripheral surface of said photosensitive drum in said electrostatic latent image-forming zone; and a guide plate for guiding the transfer paper, onto which the toner image is transferred by said transfer means, to said fixing means, said guide plate having a length in a direction that is substantially perpendicular to a conveying direction of the transfer paper guided by said guide plate, said guide plate having a side edge, said side edge defining a plurality of openings along said length of said guide plate, and wherein said process unit is fabricated as a unitary structure.

6. The process unit according to claim 5, wherein said guide plate includes a plurality of ribs, spaced at intervals, along said length of said guide plate.

* * * * *